US011333352B2

(12) United States Patent
Oh

(10) Patent No.: US 11,333,352 B2
(45) Date of Patent: May 17, 2022

(54) GAS BURNER

(71) Applicant: XENTECH CO., LTD, Seoul (KR)

(72) Inventor: Jiyun Oh, Gwangju (KR)

(73) Assignee: XENTECH CO., LTD, Seoul (KR)

( * ) Notice: Subject to any disclaimer, the term of this patent is extended or adjusted under 35 U.S.C. 154(b) by 175 days.

(21) Appl. No.: 16/513,199

(22) Filed: Jul. 16, 2019

(65) Prior Publication Data

US 2019/0338948 A1 Nov. 7, 2019

Related U.S. Application Data

(63) Continuation-in-part of application No. PCT/KR2017/012830, filed on Nov. 14, 2017.

(30) Foreign Application Priority Data

Jan. 16, 2017 (KR) ..... 10-2017-0007630

(51) Int. Cl.

| | |
|---|---|
| ***F23D 14/28*** | (2006.01) |
| ***F24C 3/14*** | (2021.01) |
| ***F24C 15/08*** | (2006.01) |
| ***F24C 3/00*** | (2006.01) |
| ***F24C 3/08*** | (2006.01) |
| ***F24C 3/10*** | (2006.01) |
| ***F24C 3/12*** | (2006.01) |

(52) U.S. Cl.

CPC ..... *F23D 14/28* (2013.01); *F24C 3/14* (2013.01); *F24C 15/08* (2013.01)

(58) Field of Classification Search

CPC ..... F23D 14/28; F24C 15/08; F24C 3/008; F24C 3/14

See application file for complete search history.

(56) References Cited

U.S. PATENT DOCUMENTS

| | | | | | |
|---|---|---|---|---|---|
| 2,928,386 | A | * | 3/1960 | Keyt | F24C 5/20 126/38 |
| 2,969,054 | A | * | 1/1961 | Axelsson | F24C 3/14 126/38 |
| 3,809,054 | A | * | 5/1974 | Bowman | F24C 3/14 126/38 |

(Continued)

FOREIGN PATENT DOCUMENTS

| | | | | | |
|---|---|---|---|---|---|
| GB | 1582432 | A | * | 1/1981 | F24C 3/14 |
| GB | 2358918 | A | * | 8/2001 | F24C 3/14 |

(Continued)

*Primary Examiner* — Jorge A Pereiro
*Assistant Examiner* — Logan P Jones

(57) ABSTRACT

The present invention relates to a gas burner. The gas burner is also called a gas range, a gas grill, or the like and used to cook food indoors or outdoors. To this end, a supply part and an extension part are configured to be foldable through a body hinge part such that the supply part, the extension part, and a cooking part may be folded into one piece, and support parts are also configured to be folded through hinges (pivots) such that the support parts may be adjacent to the supply part. The gas burner including the supply part and the cooking part further includes the extension part having a length, the other end of the supply part is connected to one end of the extension part by means of the bendable body hinge part, and the cooking part is configured at the other end of the extension part.

13 Claims, 9 Drawing Sheets

(56) References Cited

U.S. PATENT DOCUMENTS

| | | | | | |
|---|---|---|---|---|---|
| 5,117,808 | A | * | 6/1992 | Peters | F24C 3/14<br>126/25 R |
| 5,425,354 | A | * | 6/1995 | Park | F24C 3/14<br>126/50 |
| 5,884,553 | A | * | 3/1999 | Morris | A47J 36/24<br>99/337 |

FOREIGN PATENT DOCUMENTS

| | | | | |
|---|---|---|---|---|
| JP | 2015040690 | A | | 3/2015 |
| KR | 860003341 | Y1 | * | 11/1986 |
| KR | 20040060885 | A | | 7/2004 |
| KR | 200432459 | Y1 | | 12/2006 |
| KR | 200439230 | Y1 | | 3/2008 |
| KR | 20140137829 | A | | 12/2014 |

* cited by examiner

<PRIOR ART>

<PRIOR ART>

<PRIOR ART>

GAS BURNER

CROSS REFERENCE TO RELATED APPLICATIONS

This application is a by-pass continuation-in-part application, filed under 35 U.S.C. § 111, of International Patent Application No. PCT/KR2017/012830 filed on Nov. 14, 2017, which claims the benefit of Korean Patent Application No. KR 10-2017-0007630, filed on Jan. 16, 2017, is incorporated by reference herein in its entirety.

TECHNICAL FIELD

The present invention relates to a gas burner which is easily carried and used to cook food indoors and outdoors.

BACKGROUND. ART

In the related art, as illustrated in FIG. 1B, Korean Utility Model Registration No. 20-0170522 (Nov. 27, 1999) discloses a gas burner including a burner head casing 11 which accommodates a burner head for discharging a gas, and a gas container casing 14 which accommodates a gas container 13 for supplying the gas to the burner head, in which one end of the gas container casing is coupled to one end of the burner head casing by means of a hinge member, such that the gas container casing and the burner head casing may be unfolded about an axis of the hinge member.

The hinge member 20 includes a first hinge plate 22 fixed to a lateral portion of the burner head casing, and a second hinge plate 24 hingedly coupled to the first hinge plate 22 and fixed to a lateral portion of the gas container casing, or the hinge member includes a first hinge plate which is fixed to an upper portion of the burner head casing, a second hinge plate which is hingedly coupled to the first hinge plate so as to be vertically rotatable with respect to the first hinge plate, and a third hinge plate which is hingedly coupled to the second hinge plate and fixed to a lateral portion of the gas container casing so as to be rotatable leftward and rightward with respect to the second hinge plate.

A groove 12*a* is formed in a lateral portion of the burner head casing which is spaced apart from the hinge member at a predetermined distance, and a protrusion 14*a*, which is fitted into the groove 12*a*, is formed on a lateral portion of the gas container casing which corresponds to the groove 12*a*. The groove and the protrusion maintain a state in which the burner head casing and the gas container casing are completely folded.

The burner head and the gas container 13 are connected to each other through a gas supply tube 15 exposed to the outside of the burner head casing and the gas container casing. The gas supply tube is made of a flexible material such as rubber so as to stably supply the gas to the burner head even when the burner head casing and the gas container casing are folded and unfolded, and the gas supply tube is surrounded by fiberglass or iron fibers so as not to be damaged by external impact or heat.

A piezoelectric element (not illustrated) for electrically forming a flame on the burner head 11*a* is installed in the gas container casing 14, and an automatic ignition gas amount adjusting knob 16 for applying an impulse to the piezoelectric element and adjusting the amount of gas to be supplied to the burner head is installed. Further, a container mounting lever 17, which moves the gas container to the automatic ignition gas amount adjusting knob 16 to connect a discharge nozzle (not illustrated) of the gas container to the automatic ignition gas amount adjusting knob 16, is installed in the gas container casing.

In the case of the gas burner structured as described above, the container mounting lever 17 is pulled down to connect the gas discharge nozzle to the automatic ignition gas amount adjusting knob, and then the automatic ignition gas amount adjusting knob 16 is rotated to apply the impulse to the piezoelectric element and electrically generate a flame on the burner head 11, such that the gas generated from the burner head 11 is ignited. In this case, the combustion amount may be adjusted by appropriately rotating the automatic ignition gas amount adjusting knob 16.

In addition, in the related art, as illustrated in FIG. 1C, Korean Patent No. 10-1479401 (Dec. 29, 2014) discloses a portable gas range including a fuel mounting part 14, a burner part 11, and a joint part, in which the fuel mounting part includes a main body which is opened at an upper side thereof and in which a gas container is detachably accommodated, and a cover which opens or closes an opening at the upper side of the main body, and the cover is hingedly connected to the main body. Further, an adapter, which is maintained to be connected to a gas outlet of the gas container in a screw coupling manner, is provided in the fuel mounting part. A first inclined surface is formed at one side of the fuel mounting part, and the first inclined surface may be coupled and fixed to a lateral surface of the fuel mounting part by using a fastening member such as a bolt and a nut.

The burner part is configured to be supplied with fuel of the gas container from the fuel mounting part and to ignite and burn the fuel. Ignition levers 16 and 17 are provided at one side of the burner part, connected to the adapter of the fuel mounting part through gas supply tubes 15, and slidably movable horizontally, adjust and control intensity of thermal power by supplying the gas of the gas container to a flame nozzle for discharging the gas while adjusting the gas in accordance with a sliding position thereof, and ignite the gas by operating ignition switches 16 and 17. That is, when the ignition lever is slidingly moved leftward, the gas of the gas container connected to the adapter is supplied to the flame nozzle through the gas supply tube, and the ignition switch is operated, such that the gas may be ignited. In this state, when the ignition lever is slidingly moved rightward, the amount of discharged gas to be supplied to the flame nozzle may be controlled to be decreased step by step or completely blocked.

Here, the ignition switch may be implemented as a publicly known piezoelectric element that generates a spark by receiving an external force such as electrical contact, and the ignition switch may be installed to operate in conjunction with the ignition lever so that the ignition switch operates in a state in which the gas is supplied to the flame nozzle.

Further, stands 11*b* are mounted to be rotatable horizontally at upper and lower outer circumferences of the burner part and disposed to surround the burner part, and the stands 11*b* are disposed at the periphery of the flame nozzle 11*a* of the burner part to stably support various types of cooking containers when the gas burner is used and to support the burner part so that the burner part is placed horizontally with respect to an imaginary ground surface. Non-slip grooves, which prevent a slip of a cooking container placed thereon, are formed in upper surfaces of the stands, and lower surfaces of the stands are formed to be horizontally in contact with the ground surface to horizontally support the burner part.

A second inclined surface, which corresponds to the first inclined surface, is formed at the lateral surface of the burner part which faces the fuel mounting part. The second inclined surface, together with the first inclined surface and the joint part, defines a kind of hinge part, and the second inclined surface may be formed separately from a casing of the burner part and then coupled and fixed to the lateral surface of the burner part by using a fastening member such as a bolt and a nut. The joint part hingedly connects a central portion of the first inclined surface and a central portion of the second inclined surface so that the fuel mounting part is vertically folded or horizontally unfolded with respect to the burner part.

A positioning groove and a positioning protrusion are formed at a rim of the first inclined surface and a rim of the second inclined surface which face each other, and the positioning groove and the positioning protrusion are correspondingly coupled to each other to set and maintain a rotation angle and a position of the fuel mounting part with respect to the burner part. Concave-convex portions for generating torque by means of frictional force are formed to correspond to each other.

DISCLOSURE

Technical Problem

However, in the related art illustrated in FIG. 1B, a volume of the gas burner cannot be reduced at all when the gas burner is not used such as when the gas burner is carried and stored. However, the cooking part 11 for performing combustion when the gas burner is used may be just slightly distant from the other side of the supply part 14 for supplying the gas. Because the cooking part 11 is coupled to the supply part 14 by means of the hinge part 20 at all times in the state in which the cooking part 11 is positioned at a side of the body of the supply part 14, one side of the cooking part 11 is always in contact with the supply part 14, and thus the other side of the cooking part 11 cannot be greatly distant from the supply part 14.

In the related art illustrated in FIG. 1C, there is difficulty in manufacturing because the inclined surfaces are formed and connected, and thus there is concern of an increase in manufacturing costs. In addition, a length d1 is rather increased because the cooking part 11 and the supply part 14 are unfolded to be elongated in a row when the gas burner is not used. Therefore, it is inconvenient to carry and store the gas range for outdoor activities. In particular, there is a structural contradiction that a distance d2 between the cooking part 11 and the supply part 14 is rather decreased because the cooking part 11 and the supply part 14, which need to be more distant from each other compared to the original state, form a '¬' shape when the gas burner is used.

Technical Solution

To solve the above-mentioned problems, a gas burner according to the present invention includes: a supply part 100 including: an accommodation part 110 which accommodates a gas container; an adjustment part 120 to which the gas container is detachably connected and which controls a supply of gas from the gas container; and a tube part 130 which is connected to the adjustment part and delivers the gas; and a cooking part 300 including: a combustion part 310 which is connected to the tube part and performs gas combustion by being supplied with the gas; and multiple support parts 320 which are hingedly coupled around the combustion part so as to be folded or unfolded and support a container, the gas burner further includes an extension part 200 which connects the supply part and the cooking part, has the tube part disposed therein, is foldable or unfoldable by being hingedly coupled to the supply part through a body hinge part a1 so as to be bendable, the tube part further includes a bendable tube hinge part a2, and the tube hinge part is bent along with the bending of the body hinge part.

Advantageous Effects

According to the present invention, the gas burner may be easily manufactured at low cost, the gas burner may be substantially folded to minimize a volume thereof when not used, and be easily unfolded when used. Accordingly, the combustion part and the gas supply part may be maximally distant from each other to improve safety when the gas burner is used, and the gas burner may be folded to minimize a volume thereof, particularly, a length thereof when the gas burner is stored, such that the gas burner is easily carried and stored.

DESCRIPTION OF DRAWINGS

FIGS. 1A-1C illustrates background arts, in which FIG. 1A is a perspective view of a generally and widely used gas burner, and particularly, a right view thereof is a view illustrating a state in which an opening/closing part is opened, FIG. 1B illustrates a gas burner disclosed in Korean Utility Model Registration No. 20-0170522, and FIG. 1C is a perspective view and a top plan view of a gas burner disclosed in Korean Patent No. 10-1479401, and particularly, the top plan view at the right side thereof is an exemplified view illustrating a state in which the gas burner is bent for use.

Figure 1A:
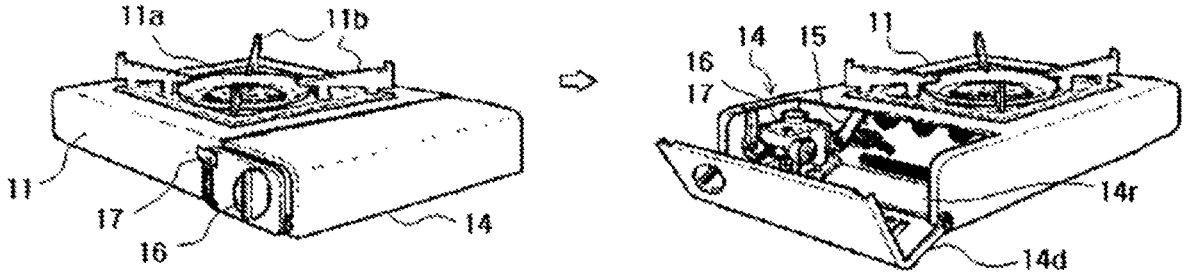
Figure 1B:
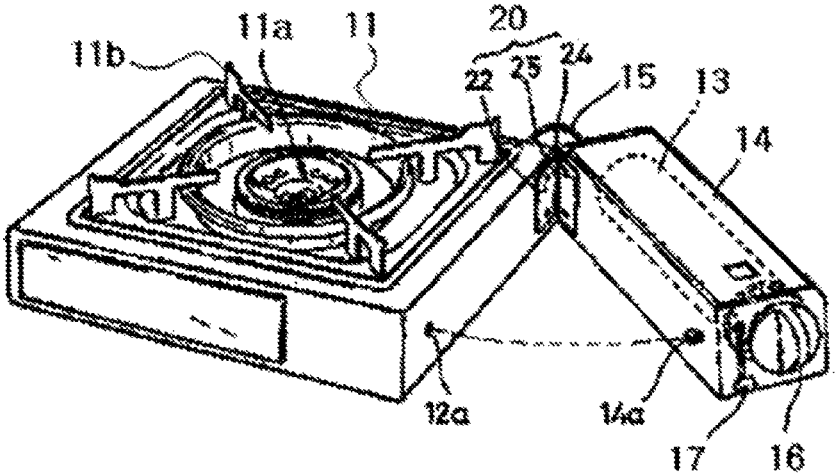
Figure 1C:
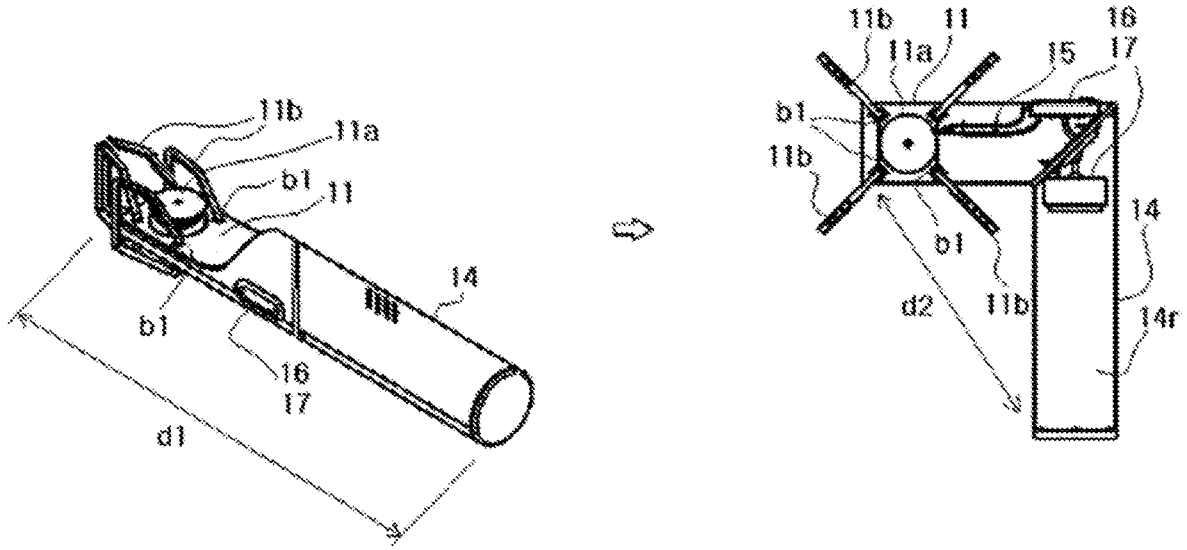

However, some reference numerals used in FIGS. 1A-1C are irrelevant to reference numerals used in FIGS. 2A to 6.

Figure 2A:
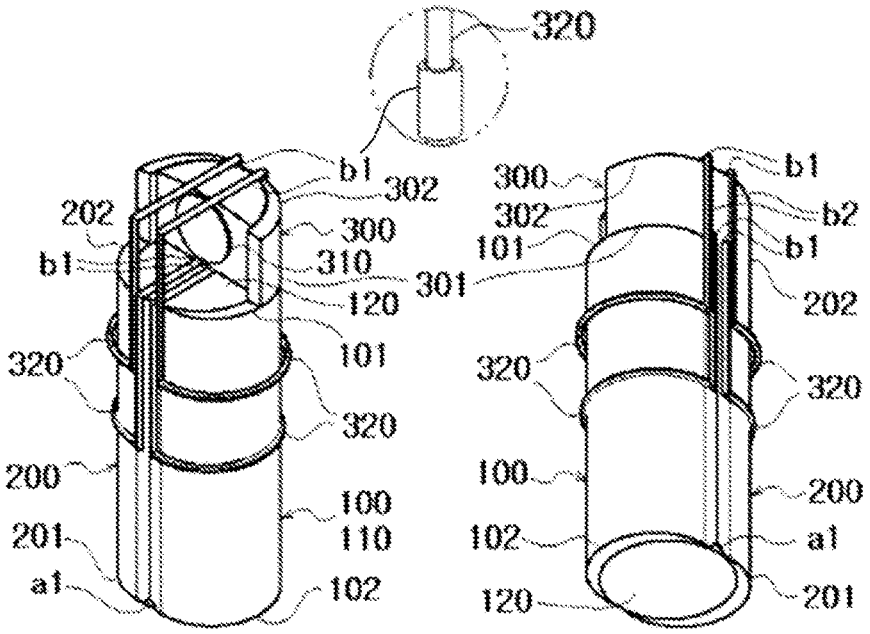
Figure 2B:
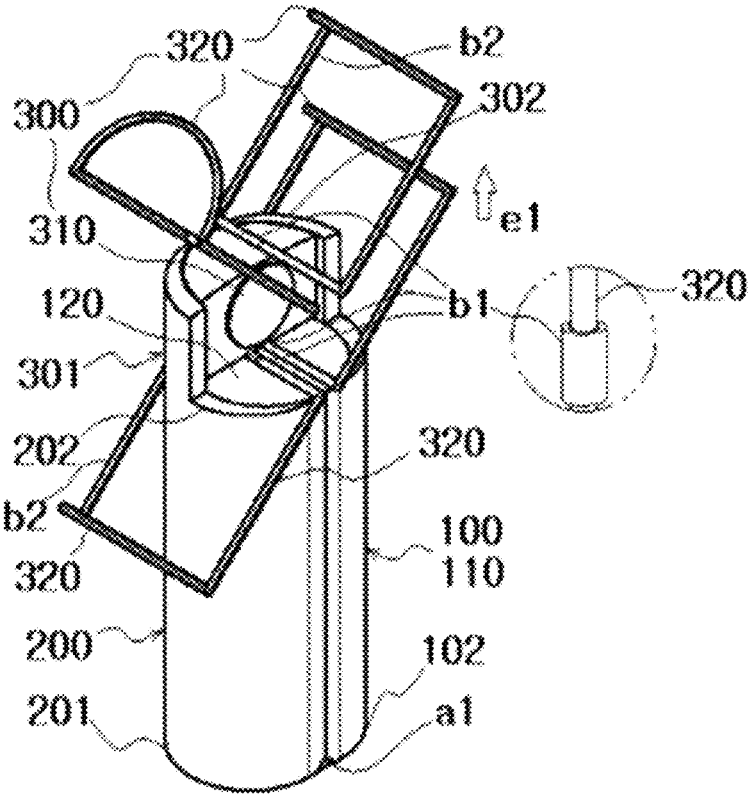
Figure 2C:
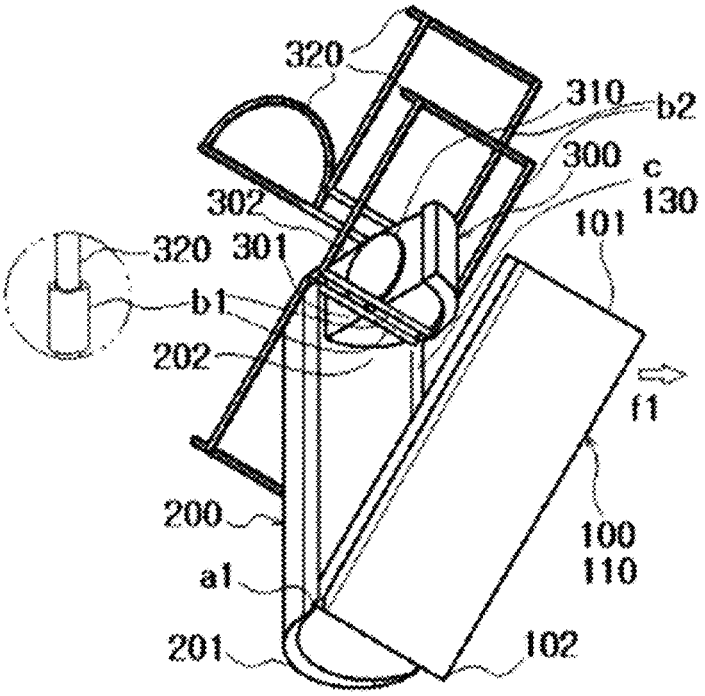

Hereinafter, the following drawings illustrate an exemplary embodiment of the present invention. In FIGS. 2A-2C, left and right views of FIG. 2A are perspective views illustrating a state in which a gas burner is completely folded when viewed in different directions, FIG. 2B is a view illustrating a state in which support parts are partially unfolded, FIG. 2C is a view illustrating a state in which a supply part is partially unfolded, and left and right views of FIG. 2D exemplify cross sections of different exemplary embodiments.

Figure 3A:
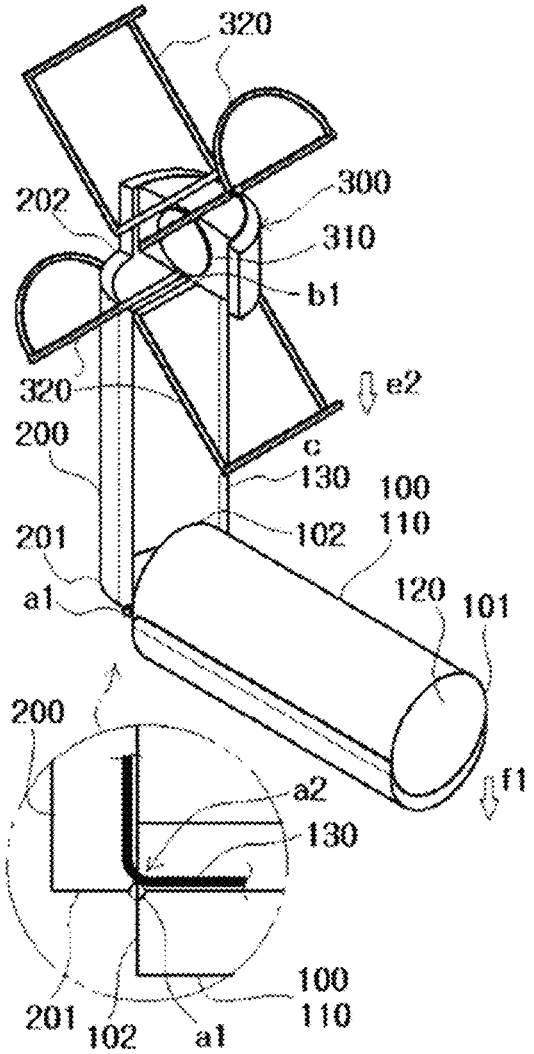
Figure 3B:
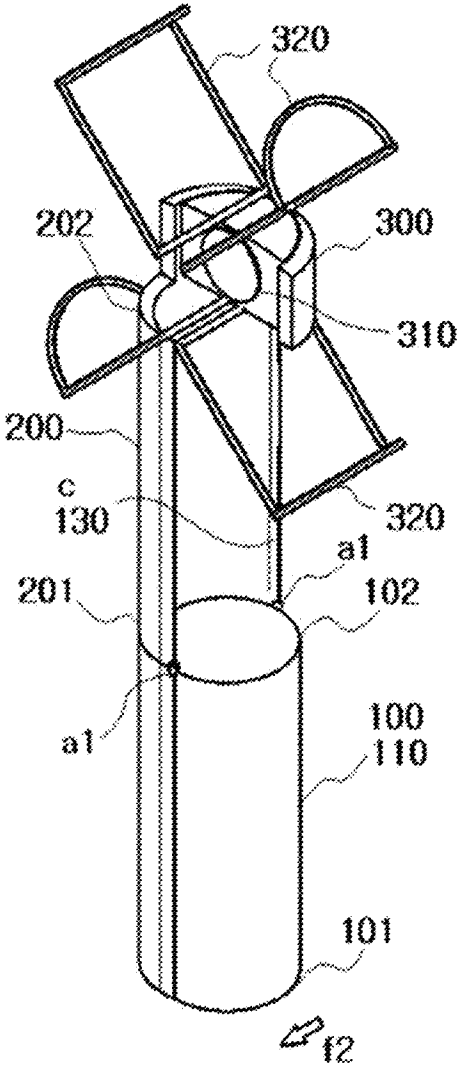

In FIGS. 3A-3B, FIG. 3A is an exemplified view illustrating a state in which the gas burner is usable by being unfolded at an approximately right angle, and FIG. 3B is a view illustrating a state in which the gas burner is usable by being completely unfolded straight so that a large container is suitably placed on the gas burner.

Figure 4A:
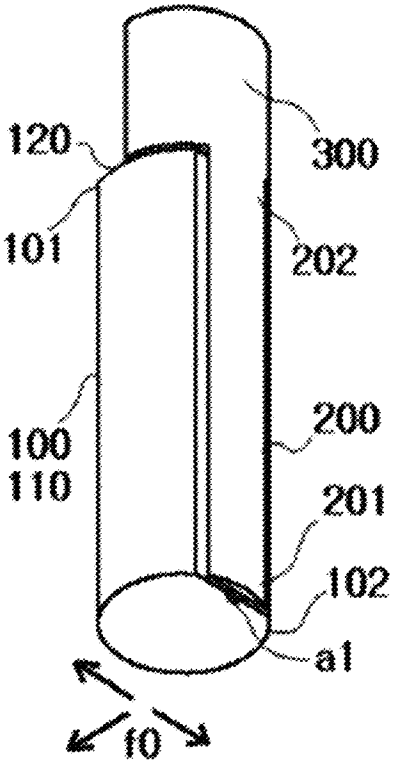
Figure 4B:
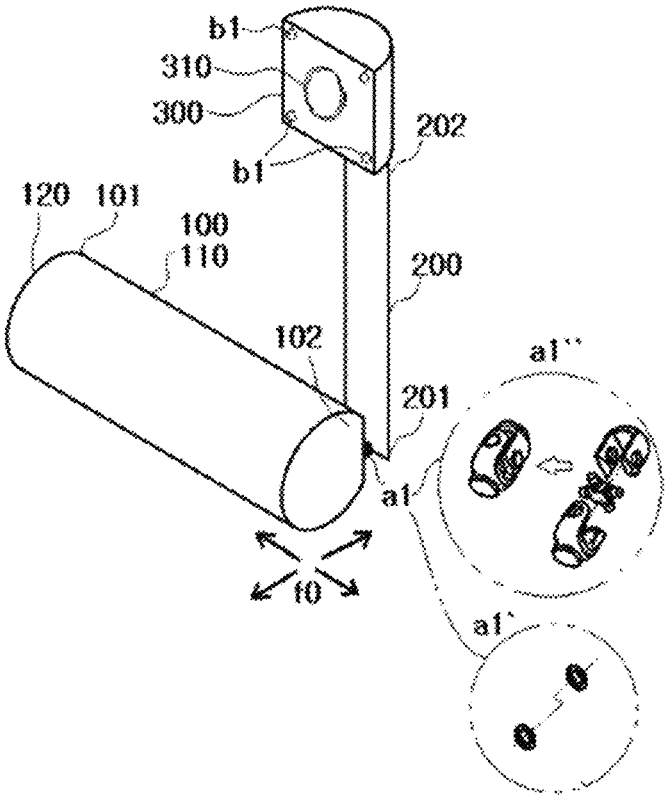
Figure 4C:
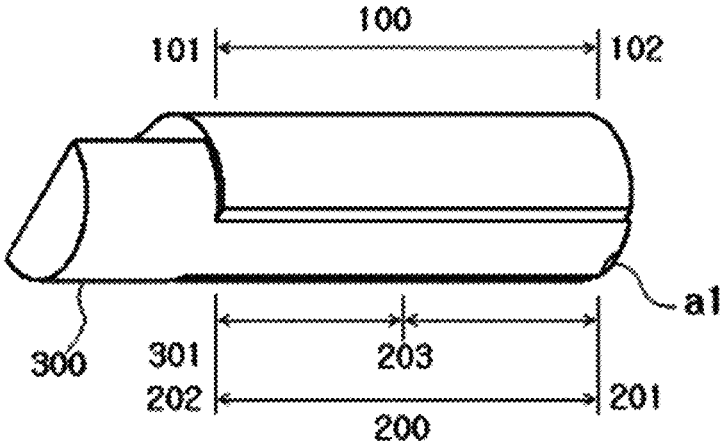

FIGS. 4A-4C illustrate another exemplary embodiment, in which FIG. 4A is a perspective view, and FIG. 4B is a perspective view illustrating a state in which a supply part is unfolded when viewed in a different direction. However, some constituent elements (the support parts, a tube part, etc.) are not illustrated. FIG. 4C is a side view for exemplifying a length ratio.

Figure 5A:
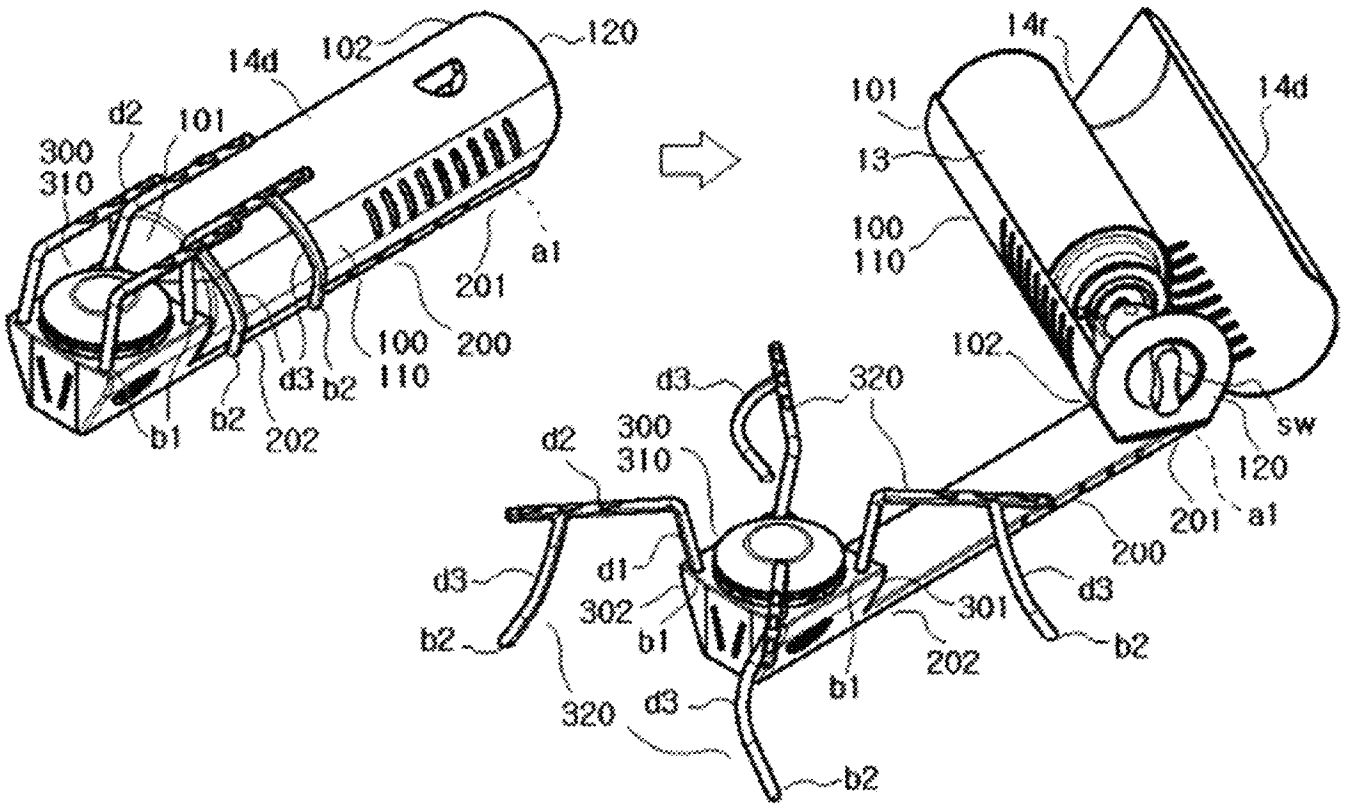
Figure 5B:
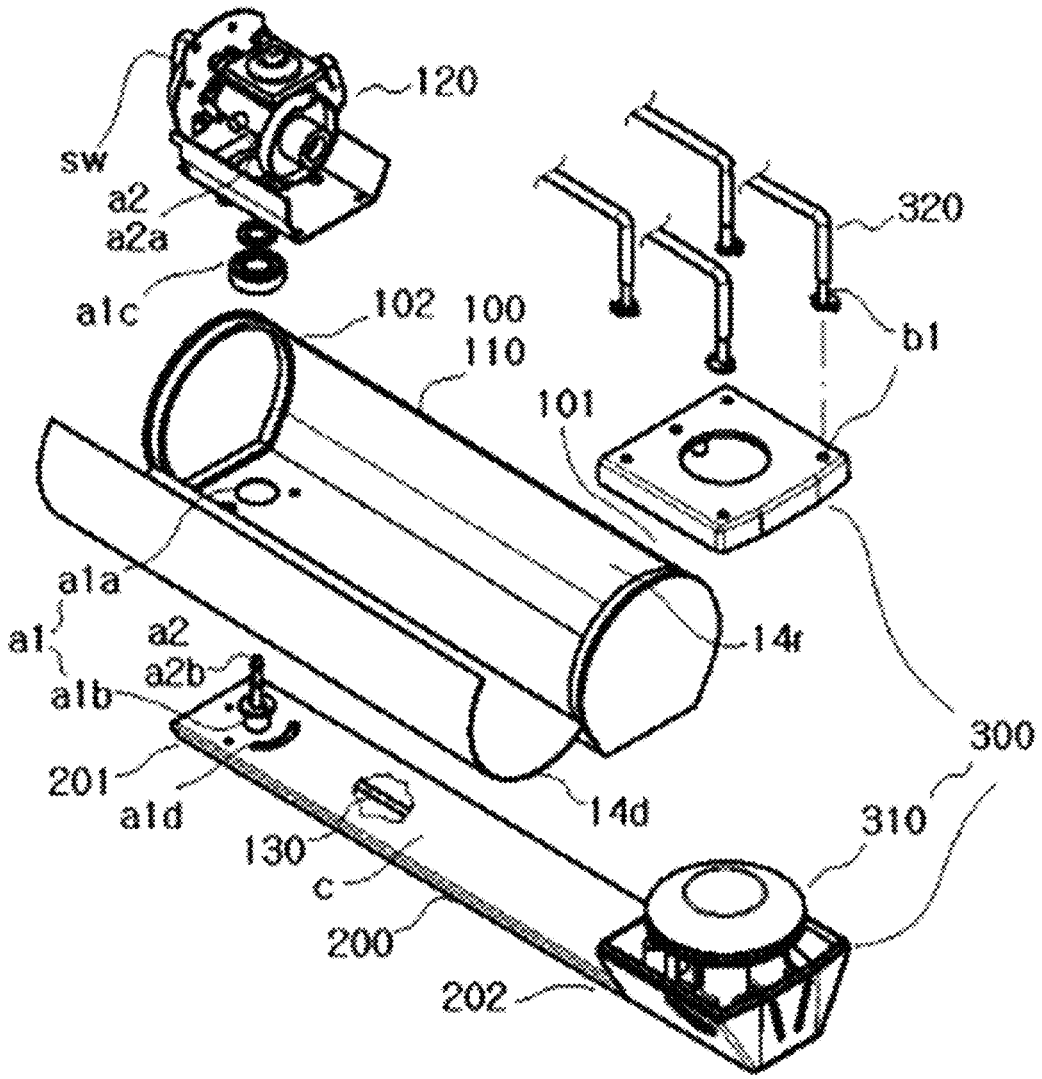

FIGS. 5A-5B illustrate still another exemplary embodiment, in which FIG. 5A is a perspective view illustrating a folded state and a perspective view illustrating an unfolded state, and FIG. 5B is an exploded perspective view.

Figure 6:
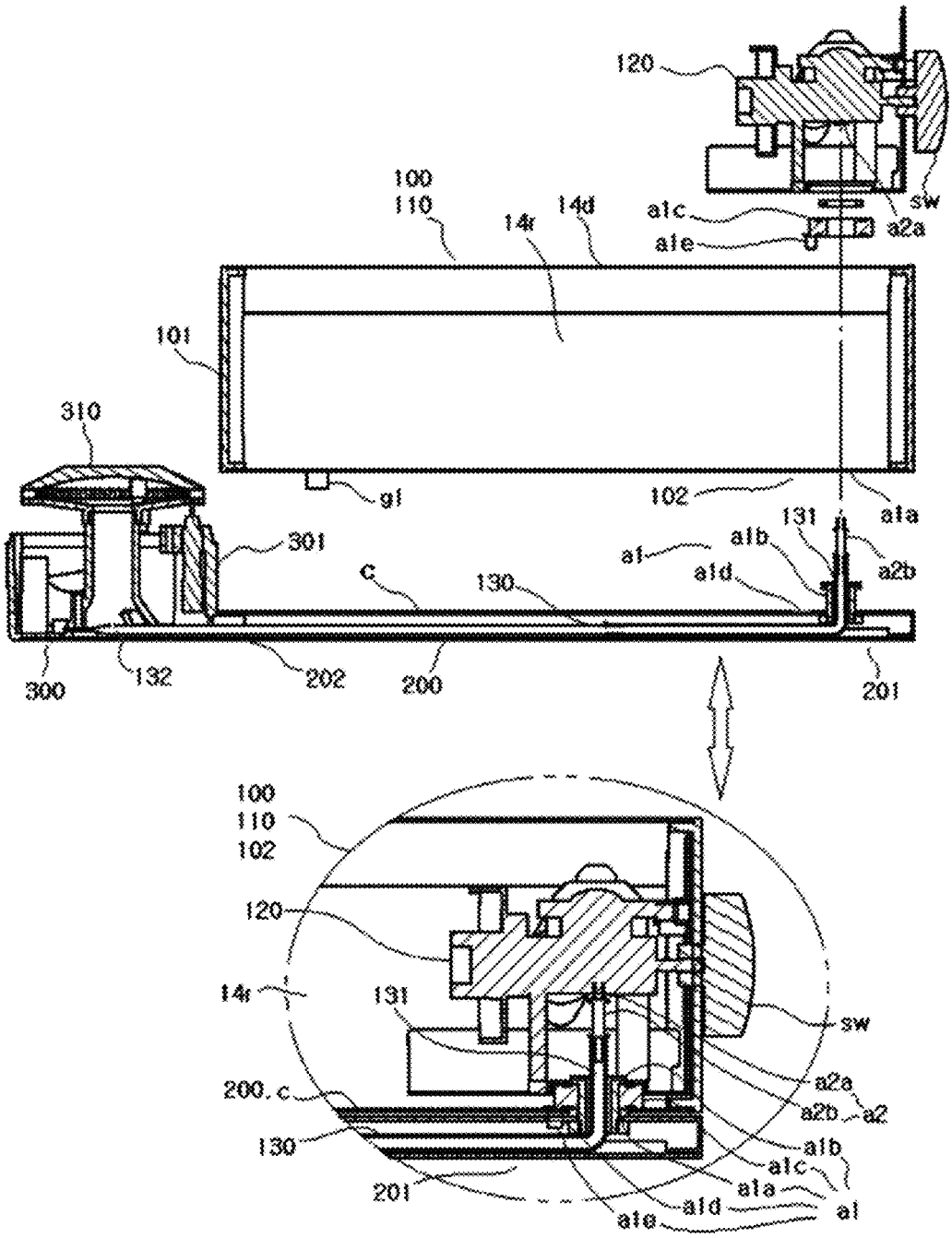

FIG. 6 is a cross-sectional side view illustrating a disassembled state and an enlarged cross-sectional side view illustrating an assembled state according to another exemplary embodiment.

BEST MODE

A gas burner according to the present invention includes a supply part and a cooking part and further includes an extension part having a length.

The gas burner is configured such that the supply part and the extension part are foldable by means of a body hinge part, and the supply part, the extension part, and a cooking part are folded into one piece so that a volume of the gas burner may be minimized when the gas burner is not used. Further, support parts are configured to be hingedly (pivotally) coupled to the cooking part and foldable so as to be adjacent to the supply part.

The other end of the supply part and one end of the extension part are connected by means of the bendable body hinge part, and the cooking part is configured at the other end of the extension part, such that in a folded mode, one end of the supply part is positioned at the other end of the cooking part or the extension part, so as for the supply part and the extension part to be aligned in parallel, which makes it possible to minimize the volume, and in an unfolded mode, the supply part and the extension part are bent about an axis of the body hinge part, so as for the supply part and the cooking part to become distant from each other.

The supply part includes an accommodation part for accommodating a gas container and an adjustment part for adjusting a supply of gas, the cooking part includes a combustion part for performing combustion and the support parts for supporting a container, the multiple support parts are provided such that one end of each of the support parts is hingedly coupled to the combustion part so as to be rotatable horizontally, the support parts are erected upward and then bent horizontally, so as for bodies of the support parts to support the container, and the support parts are bent vertically again and erected downward so that the other end of each of the support parts is in contact with the floor, and as a result, in the folded mode, the bodies of the support parts are folded in a direction toward a body of the supply part or a direction opposite to the direction, and in the unfolded mode, the bodies of the support parts are unfolded radially from the cooking part.

Mode for Invention

The present invention will be described below in detail with reference to FIGS. 2A to 6. However, a description of a configuration, which may be quoted from a publicly known technology, will be omitted. Further, FIGS. 1A-1C may be referenced.

The terms used in the present invention have dictionary meanings used in publicly known technologies. Further, the term 'bending' means that two members are curved (bent) or rotated, such that an angle between the two members varies as the two members move toward or away from each other. The term 'connection' means that two members are coupled (fastened, fixed, or attached) to each other to become the same body or means that one member extends (is formed) from the other member. The term 'hingedly coupling' means that two members are connected to be bendable. The terms 'including', 'forming', 'being configured', and 'provided' may be used as the same meaning. Heat resistance members may be adopted for constituent elements according to the present invention, and the heat resistance member means a member made of metal, a ceramic material, or synthetic resin strong against heat.

The gas burner according to the present invention includes a supply part 100, an extension part 200, and a cooking part 300.

The supply part 100 includes an accommodation part 110, an adjustment part 120, and a tube part 130.

In FIGS. 5A, 5B and 6, the accommodation part 110 has a vacant space portion 14*r* in which a gas container 13 is accommodated and fixed, and the accommodation part 110 has an openable/closable opening/closing part 14*d* such that the gas container 13 may be put into or taken out of the accommodation part 110. Meanwhile, the accommodation part 110 itself may be provided as the supply part 100, and in this case, the supply part 100 and the accommodation part 110 may be considered as the same part.

The adjustment part 120 may be configured at one end 101, the other end 102 or a lateral surface of the supply part 100 within a range in which the adjustment part 120 does not mechanically interfere with other elements. FIGS. 5A-5B and 6 illustrate an example in which the adjustment part 120 is configured at the other end 102 of the supply part. In general, the gas container 13 may be detached from the adjustment part 120 when the gas container 13 is accommodated in the accommodation part 110, and the adjustment part 120 adjusts a supply of gas to be burned and controls gas ignition. FIGS. 2A to 4 illustrate only a position at which the adjustment part 120 is to be disposed.

In FIGS. 3A, 5B, and 6, the tube part 130 includes a tube hinge part a2 which is bent together with a body hinge part a1. The body hinge part a1 serves as a rotation axis when the supply part 100 and the extension part 200 are bent. In the example illustrated in FIG. 3A, the tube hinge part a2 is provided as a bendable and flexible gas hose member and configured to be bent together with the supply part 100 and the extension part 200 when the supply part 100 and the extension part 200 are bent to be folded or unfolded. In this regard, the reference may be made to a gas supply tube 15 illustrated in FIGS. 1A-1C. In the example illustrated in FIGS. 5B and 6, a tube passing hole, like a pipe hole, is bored in the body hinge part a1 along a length of the body hinge part a1. The tube hinge part a2 through which one end 131 of the tube part 130 is inserted and passes may be additionally provided in the tube passing hole. The tube part 130 connects to the extension part 200 from the supply part 100 through the tube hinge part a2. When the supply part 100 and the extension part 200 are rotated and bent, the tube part 130 is bent as the tube hinge part a2 is rotated or twisted in accordance with the rotation and bending of the supply part 100 and the extension part 200. In FIG. 6, the one end 131 of the tube part 130 is connected to the adjustment part 120 of the supply part 100, such that the supply of gas is adjusted. A middle body of the tube part 130 is disposed along a length of the extension part 200 to deliver the gas, and the other end 132 of the tube part 130 is connected to a combustion part 310 of the cooking part 300 to finally deliver the gas. In more detail, the tube hinge part a2 has a gas nozzle a2*a* vertically provided below the adjustment part 120, the tube hinge part a2 has a connection tube a2*b*, and the gas nozzle a2*a* of the adjustment part 120 and one end 131 and the tube part 130 are configured to be connected to and fitted with ends of the connection tube a2*b* to be rotatable while preventing a leakage of gas.

An electric wire for controlling the gas ignition is provided together with the tube part 130 along the tube part 130, such that the gas ignition in the combustion part 310 is controlled by the adjustment part 120. A specific method of connecting one end 131 of the tube part 130 and the other end 132 of the tube part 130 to the adjustment part 120 and the combustion part 310, respectively, may follow a publicly known method of connecting a gas line.

In FIG. 6, the body hinge part a1 may include a body coupling hole ala which is vertically formed below the other end 102 of the supply part 100, a body rotating shaft a1*b* which protrudes upward from the other end 202 of the extension part 200 and is fitted into the body coupling hole ala so as to serve as a horizontal rotation axis, a bearing a1*c* which assists and supports the body rotating shaft a1*b*, an angle restricting groove a1*d* which is spaced apart from the body rotating shaft a1*b* and recessed at the other end 202 of the extension part 200, and an angle restricting groove a1*e* which protrudes downward from the adjustment part 120 of the supply part 100 or the bearing a1*e* and is fitted into and caught by the angle restricting groove a1*d* to restrict angles of leftward and rightward rotations.

The extension part 200 may be provided as a hard member having a length to always maintain the same shape, or the extension part 200 may be provided as a flexible member so as to be adapted to the peripheral environment while being bent at a predetermined portion. The extension part 200 has the same length as the supply part 100. Here, the term 'the same length' means a minimum or longer length that may allow the supply part 100 embedded with the gas container 13 to be safely spaced apart from the cooking part 300, which generates heat, when the gas burner is unfolded to switch from a minimum size to a maximum size. In the example illustrated in FIG. 4C, the extension part 200 has a length approximately between a length of the supply part 100 and a half 203 of the length. The supply part 100 is in contact with the cooking part 300, and then the supply part 100 may be maximally spaced apart from the cooking part 300 by the length of the supply part 100. If the extension part 200 is longer in length than the supply part 100, the supply part 100 may correspondingly be more distant from the cooking part 300.

A shape of the extension part 200 corresponds to an external shape of the supply part, and the extension part 200 and the supply part may be placed in parallel in a straight line along the supply part so as to overlap each other. To improve an aesthetic appearance and integrity and minimize obstruction, the extension part 200, together with the supply part 100, may maintain a single integrated external shape after the extension part 200 and the supply part 100 overlap each other. To this end, a thickness (width) of the extension part 200 may be formed in the form of a rectangular plate or a rod (a pipe, a stick, etc.), as illustrated in FIGS. 4A-4C. Meanwhile, the extension part 200 may have various forms such as a wavy shape and a zigzag shape to express uniqueness of an external appearance.

The extension part 200 may be positioned at any side among upper, lower, left, and right sides of the supply part 100. In the example illustrated in FIGS. 4A to 5B, the supply part 100 is disposed above the extension part 200, and in this case, there is an advantage in that it is possible to minimize an interference when the supply part 100 is unfolded from the extension part 200. That is, when the extension part 200 is disposed at the bottom of the supply part 100, the supply part 100, which is placed on the extension part 200, may be freely bent upward, leftward, or rightward without interfering with and being caught by the extension part 200. Since the tube part 130 is disposed along the extension part 200, the tube part 130 is disposed at a lower position. This is advantageous in view of safety because the tube part 130 is more distant downward from heat generated in the combustion part 310 of the cooking part 300. Further, the extension part 200 itself may serve as a stand of the gas burner, thereby helping the gas burner to stably stand.

The extension part 200 may include a shield part c that protects the tube part 130 by preventing the tube part 130 from being exposed to the outside. In FIGS. 3A-3B, the shield part c may be provided as a protective tube in the form of a hose or a pipe. In the example illustrated in FIGS. 5A-5B and 6, the shield part c has an inner passageway formed along the length of the extension part 200, and the tube part 130 is mounted in the inner passageway.

In the cooking part 300, one end 301 of the cooking part is connected to the other end 202 of the extension part, the combustion part 310, which performs gas ignition and combustion, is provided at a center of an upper end of the cooking part 300, and support parts 320, which support a container, are provided around the combustion part 310.

In FIG. 5A, the multiple support parts 320 are provided, and one end b1 of each of the support parts 320 is hingedly coupled to the cooking part 300 so as to be horizontally rotatable, such that bodies of the support parts 320 are erected upward, horizontal bodies d2 bent horizontally are disposed to support a container, vertical bodies d3 bent downward are provided to correspond to the shape of the supply part, and then the other ends b2 of the support parts positioned at lower ends of the vertical bodies d3 are in contact with and supported on the floor. The support parts 320 are configured to be hingedly coupled to be horizontally folded or unfolded.

In FIG. 5A, the support parts 320 according to the present invention are bent corresponding to the supply part 100 and are in close contact with the supply part 100. The vertical bodies d3 of the support parts 320 surround, overlap, and correspond to an external shape (an outer circumference or an external appearance) of the supply part 100, thereby defining one piece. That is, the vertical bodies d3 of the support parts 320 are correspondingly bent along an external shape of a cross section of the supply part 100. Therefore, it is possible to provide good aesthetic appearances to the supply part 100 and the support parts 320, improve integrity, and minimize obstruction when the support parts 320 are folded toward the supply part 100.

In a case in which the extension part 200 is configured to cover a part of the lateral surface of the supply part 100 such that the support parts 320 are in contact with the extension part 200 as illustrated in FIG. 2A, the bodies of the support parts 320, which are in contact with the extension part 200, need to be bent corresponding to the external shape of the extension part 200. In this regard, the configuration in which the support parts 320 are also bent corresponding to the shape of the supply part 100 includes a configuration in which the support parts 320 are also bent corresponding to the external shape of the extension part 200 when the support parts 320 are in contact with the extension part 200.

Figure 2D:
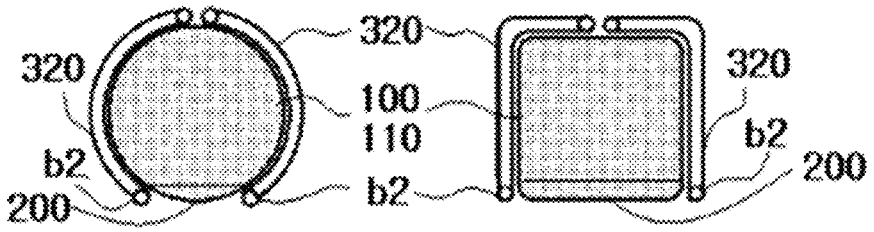

The left view of FIG. 2D illustrates a cross section in a case in which the body of the supply part 100 is approximately circular as illustrated in FIG. 4A-4C or 5A-5B, and illustrates an example in which the support parts 320 are also bent in an approximately circular shape. The right view of FIG. 2D illustrates a cross section in a case in which the body of the supply part has a box shape, and illustrates an example in which the support parts 320 are also bent to have a quadrangular shape. The left view of FIG. 2D illustrates the example in which the supply part 200 and the extension part 200 define a cylindrical shape together such that the cross section thereof has an integrated circular shape, as illustrated in FIGS. 4A and 4B.

The other end 102 of the supply part and one end 201 of the extension part are hingedly coupled by means of the body hinge part a1. That is, the supply part 100 and the extension part 200 are connected to be bendable by means of the body hinge part a1. When the body hinge part a1 is bent to be folded or unfolded, the supply part 100 and the extension part 200 may be folded and overlap each other when the gas burner is not used (the gas burner is carried and stored). That is, one end 101 of the supply part and the other end 202 of the extension part may be integrated. Therefore, one end 101 of the supply part and one end 301 of the cooking part 300 may meet together. That is, the supply part 100 and the cooking part 300 may be in close contact with each other or approach each other.

On the contrary, the supply part 100 and the extension part 200 may be unfolded when the gas burner is used. That is, one end 101 of the supply part and the other end 202 of the extension part may be distant from each other. Therefore, one end 101 of the supply part may be maximally distant from one end 301 of the cooking part. That is, the supply part 100 and the cooking part 300 may be unfolded and spaced apart from each other at a long distance.

One end 101 of the supply part approaches one end 301 of the cooking part/the other end 202 of the extension part, such that the supply part 100 and the extension part 200 overlap each other so as to minimize the volume, and on the contrary, the other end 102 of the supply part and one end 201 of the extension part are hingedly coupled to be bendable by means of the body hinge part a1 such that the supply part 100 and the extension part 200 become distant from each other so as to maximize the volume.

The body hinge part a1 may be a typical hinge a' member that is rotated like scissors and bent in directions f1 and f2 on a two-dimensional plane. Alternatively, the body hinge part a1 may be a member such as a universal joint a", a sphere joint, a bendable synthetic resin member of which the direction may switch to any three-dimensional direction, and as a result, the body hinge part a1 may be bendable in multiple directions 10. In this regard, the reference is made to FIGS. 2C, 3A, 3B, 4A, 4B, 5A, 5B, and 6.

In a folded mode in which the gas burner is folded as illustrated in FIGS. 2A and 5A, one end 101 of the supply part and one end 301 of the cooking part/the other end 202 of the extension part may be in contact with each other or adjacent to each other at a short distance. Therefore, the supply part 100 and the extension part 200 may be aligned in parallel and overlap each other, an overall length and an overall width of the gas burner are greatly reduced, thereby minimizing the volume. In this case, a typical locking device may be additionally provided to continuously maintain the folded mode, and frictional force may be used to prevent unlocking, or a catching device including a main part and a protrusion may be additionally provided.

The support parts 320 are aligned in parallel in the longitudinal direction of the supply part 100, such that left and right widths of the gas burner may be reduced. In addition, when the support parts 320 are folded toward the supply part 100 and aligned to be in close contact with an outer side of the supply part, as illustrated in FIGS. 2A and 5A, the overall length of the gas burner may be further minimized. Therefore, the shapes of the bodies of the support parts 320 need to correspond to the external shape of the body of the supply part 100 so that the bodies of the support parts 320 may surround and overlap the external shape of the supply part 100. In an exemplary embodiment shown in FIG. 5A, The upper horizontal bodies d2 of the support parts 320, which support a container, are aligned in parallel with an upper side of a length of the body of the supply part 100, and the vertical bodies d3, which are bent downward and support the ground surface, need to be bent downward to surround left and right surfaces of the cross section of the body of the supply part 100 In this case, the support parts 320 may be spaced apart from one another to have a necessary space so that the support parts 320 do not interfere with one another, and this configuration is considered when the support parts 320 correspond to the external shape of the body of the supply part 100.

To maintain the folded state after the support parts 320 are in contact with the outer circumference of the supply part 100, a fitting protrusion and a protrusion receiver may be provided on the supply part and a stand and integrated like a snap button, the support parts 320 and the supply part 100 may be attached by using a magnet, or a predetermined state may be maintained by increasing frictional force of rotating shafts of hinges. This configuration may be applied to maintain the folded states of the supply part 100 and the extension part 200.

Specifically, referring to the exemplary embodiment illustrated in FIGS. 2A, 2B, 2C, 3A and 3B, the support parts 320 include "multiple outer support parts" each having one end b1 hingedly coupled to the other end 302 of the cooking part 300 so as to be rotatable horizontally, and "multiple inner support parts" each having one end b1 hingedly coupled to one end 301 of the cooking part 300 so as to be rotatable horizontally.

Therefore, the "outer support parts" and the "inner support parts" are hingedly coupled to the cooking part 300 so as to be folded or unfolded horizontally.

In this case, each of the "outer support part" and the "inner support part" may be formed to correspond to the shape of the accommodation part 110 or the extension part 200.

Therefore, in a folded mode of the supply part 100 and the extension part 200, the "outer support parts" and the "inner support parts" are disposed in parallel with the longitudinal direction of the accommodation part 110 or the extension part 200 and bent to correspond to the lateral surface of the accommodation part 110 or the extension part 200 so as to be in close contact with the extension part 200 or the accommodation part 110.

That is, in the folded mode, the "outer support parts" and the "inner support parts" surround and overlap the external shape (the outer circumference or the external appearance) of the accommodation part 110 or the extension part 200 so as to be formed to correspond to and be integrated with the external shape, thereby reducing a horizontal width of the gas burner and easily storing the gas burner.

Meanwhile, in an unfolded mode of the supply part 100 and the extension part 200, the "outer support parts" and the "inner support parts" are radially spread about the cooking part 300 or the combustion part 310, such that the "outer support parts" and the "inner support parts" support the container in the state in which the "outer support parts" and the "inner support parts" are in contact with the floor.

In addition, an overall shape of the multiple "outer support parts" or the multiple "inner support parts" may be quadrangular or semi-circular, as illustrated in FIGS. 2A, 2B, 2C 3A and 3B.

Referring to the configuration illustrated in FIGS. 5A, 5B as another exemplary embodiment of the present invention, the support parts 320 include: three or more rotating pins d1 which are vertically and rotatably connected to the cooking part 300; three or more horizontal bodies d2 which are connected to upper ends of the rotating pins d1, respectively, disposed horizontally, and rotatable about the rotating pins d1, respectively; and three or more vertical bodies d3 which are connected to the horizontal bodies d2, respectively, to support the horizontal bodies d2, and have shapes that correspond to the lateral surfaces of the accommodation part 110.

Meanwhile, in the folded mode of the supply part 100 and the extension part 200, the horizontal bodies d2 are aligned in parallel with the supply part 100 toward the supply part 100, and the vertical bodies d3 are disposed around and surround the lateral surfaces of the accommodation part 110.

In addition, in the unfolded mode of the supply part 100 and the extension part 200, the horizontal bodies d2 are disposed radially about the combustion part 310 and may support the container through the vertical bodies d3.

That is, in the unfolded mode, the bodies of the support parts 320 are radially unfolded based on the cooking part 300 so as to support a container. First, the bodies of the support parts 320, which surround the body of the supply part 100 as illustrated in FIG. 2B, are further moved (e1) toward the other end 302 of the cooking part to form a path (space) in which the supply part 100 moves while rotating. Next, the body hinge part a1, which serves as a rotation axis as illustrated in FIG. 2C, is rotated to make an unfolded state f1 between the supply part 100 and the extension part 200. That is, the supply part 100 and the cooking part 300 become distant from each other. Thereafter, like the example illustrated in FIG. 3A, the support parts 320 are slightly bent (moved) again toward the extension part 200 to finally make an unfolded state e2 in which the support parts 320 are symmetrical to one another, thereby supporting a container. The cooking may be performed in a state in which the support parts are unfolded at various angles such as an acute angle illustrated in FIG. 2C, a right angle illustrated in FIG. 3A, or an obtuse angle illustrated in the right view of FIG. 5A in accordance with a size of a container or an ambient environment. Alternatively, like the example illustrated in FIG. 3B, a completely and straight unfolded state t2 is maintained to allow the supply part 100 to be maximally distant from the cooking part 300, and in this case, safety may be maintained against heat from the cooking part 300 even though a container having a large volume is placed on the cooking part 300. Further, there may be a difference in height between a bottom surface of the extension part 200 and a bottom surface of the supply part 100 after the supply part 100 placed on the extension part 200 is unfolded, and as a result, one part may be lifted up or inclined. To prevent this problem, as shown in FIG. 6, a stepped stand g1, which protrudes downward, may be provided below one side of each of the left and right sides of the supply part 100.

INDUSTRIAL APPLICABILITY

The industrial availability of the present invention is high because the volume of the gas burner may be minimized when the gas burner is not used, the gas burner may be easily unfolded to maximize the volume of the gas burner to stably support a container when the gas burner is used, the number of members used for the body of the gas burner may be minimized, and the gas burner may be easily manufactured at low production cost.

The invention claimed is:

1. A gas burner comprising:

a supply part including:

an accommodation part which accommodates a gas container;

an adjustment part to which the gas container is detachably connected and which controls a supply of gas from the gas container; and a tube part which is connected to the adjustment part and delivers the gas;

a cooking part including:

a combustion part which is connected to the tube part and performs gas combustion by being supplied with the gas; and multiple support parts which are hingedly coupled around the combustion part so as to be folded or unfolded and support a container; and an extension part which connects the supply part and the cooking part, is disposed such that the tube part delivers the gas, and is hingedly and bendably coupled to the supply part through a body hinge part so as to move the supply part with respect to the extension part, wherein the support parts include:

multiple rotating pins which are vertically and rotatably connected to the cooking part;

multiple horizontal bodies which are connected to upper ends of the rotating pins, respectively, disposed horizontally, and rotatable about the rotating pins, respectively; and multiple vertical bodies which are connected to the horizontal bodies, respectively, to support the horizontal bodies, and have shapes that correspond to lateral surfaces of the accommodation part, wherein the tube part comprises a tube hinge part, the tube hinge part including:

a gas nozzle provided below the adjustment part; and a connection tube rotatably coupled to an end of the tube part, wherein the body hinge part includes:

a body coupling hole formed below an end of the supply part; and a body rotating shaft protruding from an end of the extension part and being coupled to the body coupling hole, wherein the end of the tube part protrudes from the body rotating shaft.

2. The gas burner of claim 1, wherein the tube hinge part is bent together with the supply part and the extension part when the supply part and the extension part are bent.

3. The gas burner of claim 1, wherein one end of the supply part is in close contact with one end of the cooking part or the other end of the extension part in a folded mode of the supply part and the extension part, and one end of the supply part is spaced apart from one end of the cooking part or the other end of the extension part in an unfolded mode of the supply part and the extension part.

4. The gas burner of claim 3, wherein in the folded mode of the supply part and the extension part, the support parts are aligned in parallel in a longitudinal direction of the supply part, and are in contact with the supply part so as to correspond to an external shape of the supply part.

5. The gas burner of claim 1, wherein the multiple horizontal bodies are aligned in parallel with the supply part toward the supply part and the multiple vertical bodies are disposed around the lateral surface of the accommodation part to surround the accommodation part, in a folded mode of the supply part and the extension part, and the multiple horizontal bodies are radially disposed about the combustion part and support the container by means of the multiple vertical bodies in an unfolded mode of the supply part and the extension part.

6. The gas burner of claim 1, wherein an angle at which the supply part and the cooking part are unfolded is variously adjusted in accordance with a rotation of the body hinge part.

7. A gas burner comprising:

a supply part including:

an accommodation part which accommodates a gas container;

an adjustment part to which the gas container is detachably connected and which controls a supply of gas from the gas container; and a tube part which is connected to the adjustment part and delivers the gas; and a cooking part including:

a combustion part which is connected to the tube part and performs gas combustion by being supplied with the gas; and multiple support parts which are hingedly coupled around the combustion part so as to be folded and unfolded and support a container; and an extension part which connects the supply part and the cooking part, is disposed such that the tube part delivers the gas, and is hingedly and bendably coupled to the supply part through a body hinge part so as to move the supply part with respect to the extension part, wherein the support parts include:

multiple outer support parts each having one end hingedly coupled to the other end of the cooking part so as to be rotatable horizontally; and multiple inner support parts each having one end hingedly coupled to one end of the cooking part so as to be rotatable horizontally, and the multiple outer support parts and the multiple inner support parts are formed to correspond to a lateral surface of the accommodation part or the extension part, wherein each of the multiple outer support parts is rotatably coupled to a first surface of the other end of the cooking part and each of the multiple inner support parts is rotatably coupled to a second surface of the one end of the cooking part, the second surface being spaced apart from the first surface in an axial direction of the cooking part, wherein the tube part comprises a tube hinge part, the tube hinge part including:

a gas nozzle provided below the adjustment part; and a connection tube rotatably coupled to an end of the tube part, wherein the body hinge part includes:

a body coupling hole formed below an end of the supply part; and a body rotating shaft protruding from an end of the extension part and being coupled to the body coupling hole, wherein the end of the tube part protrudes from the body rotating shaft.

8. The gas burner of claim 7, wherein the tube hinge part is bent together with the supply part and the extension part when the supply part and the extension part are bent.

9. The gas burner of claim 7, wherein one end of the supply part is in close contact with one end of the cooking part or the other end of the extension part in a folded mode of the supply part and the extension part, and one end of the supply part is spaced apart from one end of the cooking part or the other end of the extension part in an unfolded mode of the supply part and the extension part.

10. The gas burner of claim 9, wherein in the folded mode of the supply part and the extension part, the support parts are aligned in parallel in a longitudinal direction of the supply part, and are in contact with the supply part so as to correspond to an external shape of the supply part.

11. The gas burner of claim 7, wherein in a folded mode of the supply part and the extension part, the multiple outer support parts and the multiple inner support parts are disposed in parallel with a longitudinal direction of the accommodation part or the extension part and bent to correspond to the lateral surface of the accommodation part or the extension part so as to be in close contact with the accommodation part or the extension part, and in an unfolded mode of the supply part and the extension part, the multiple outer support parts and the multiple inner support parts are radially spread about the cooking part or the combustion part such that the container is supported by the multiple outer support parts and the multiple inner support parts.

12. The gas burner of claim 7, wherein the multiple outer support parts and the multiple inner support parts are formed in a quadrangular or semi-circular shape.

13. The gas burner of claim 7, wherein an angle at which the supply part and the cooking part are unfolded is variously adjusted in accordance with a rotation of the body hinge part.

* * * * *